US009920601B2

(12) United States Patent
Carrejo et al.

(10) Patent No.: US 9,920,601 B2
(45) Date of Patent: Mar. 20, 2018

(54) DISINTEGRATING PLUGS TO DELAY PRODUCTION THROUGH INFLOW CONTROL DEVICES

(71) Applicant: BAKER HUGHES INCORPORATED, Houston, TX (US)

(72) Inventors: Nicholas Carrejo, Katy, TX (US); Adriana Hightower, Cypress, TX (US); Tarik Abdelfattah, Houston, TX (US); Nadine Macklin, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/043,096

(22) Filed: Feb. 12, 2016

(65) Prior Publication Data

US 2016/0237782 A1 Aug. 18, 2016

Related U.S. Application Data

(60) Provisional application No. 62/116,802, filed on Feb. 16, 2015.

(51) Int. Cl.
*E21B 43/12* (2006.01)

(52) U.S. Cl.
CPC ..... *E21B 43/12* (2013.01)

(58) Field of Classification Search
CPC ..... E21B 43/12
See application file for complete search history.

(56) References Cited

U.S. PATENT DOCUMENTS

| | | | | |
|---|---|---|---|---|
| 5,526,881 | A * | 6/1996 | Martin | B21C 37/15 166/205 |
| 9,090,955 | B2 | 7/2015 | Xu et al. | |
| 2005/0056425 | A1* | 3/2005 | Grigsby | E21B 43/12 166/296 |
| 2008/0314590 | A1 | 12/2008 | Patel | |
| 2009/0101344 | A1 | 4/2009 | Crow et al. | |
| 2011/0180271 | A1 | 7/2011 | Brekke et al. | |
| 2013/0068467 | A1 | 3/2013 | Zhou | |
| 2015/0308238 | A1* | 10/2015 | Langlais | E21B 34/06 166/278 |
| 2015/0308239 | A1* | 10/2015 | Langlais | E21B 34/06 166/278 |
| 2015/0337623 | A1* | 11/2015 | Carrejo | E21B 29/02 166/373 |

(Continued)

FOREIGN PATENT DOCUMENTS

WO 2014105082 A1 7/2014

OTHER PUBLICATIONS

PCT/US2016/017956—International Search Report dated May 31, 2016.

*Primary Examiner* — Matthew R Buck
*Assistant Examiner* — Aaron L Lembo
(74) *Attorney, Agent, or Firm* — Mossman, Kumar & Tyler, PC

(57) ABSTRACT

An apparatus for controlling a flow of a fluid between a wellbore tubular and a wellbore annulus includes an inflow control device having an opening in fluid communication with a bore of the wellbore tubular, a first particulate control device forming a first fluid stream conveyed to the inflow control device; and at least one degradable flow blocker blocking fluid flow through the inflow control device.

13 Claims, 4 Drawing Sheets

(56) References Cited

U.S. PATENT DOCUMENTS

| | | | | |
|---|---|---|---|---|
| 2016/0317957 | A1* | 11/2016 | Carrejo | B01D 29/01 |
| 2016/0333655 | A1* | 11/2016 | Fripp | E21B 33/063 |
| 2016/0369592 | A1* | 12/2016 | Aitken | E21B 34/063 |

* cited by examiner

DISINTEGRATING PLUGS TO DELAY PRODUCTION THROUGH INFLOW CONTROL DEVICES

CROSS-REFERENCE TO RELATED APPLICATIONS

This application claims priority from U.S. Provisional Application Ser. No. 62/116,802 filed on Feb. 16, 2015, the entire disclosure of which is incorporated herein by reference in its entirety.

BACKGROUND OF THE DISCLOSURE

1. Field of the Disclosure

The disclosure relates generally to systems and methods for selective control of fluid flow between a flow bore of a tubular and a formation.

2. Description of the Related Art

Hydrocarbons such as oil and gas are recovered from subterranean formations using a well or wellbore drilled into such formations. In some cases the wellbore is completed by placing a casing along the wellbore length and perforating the casing adjacent each production zone (hydrocarbon bearing zone) to extract fluids (such as oil and gas) from such a production zone. In other cases, the wellbore may be open hole, and in a particular case may be used for injection of steam or other substances into a geological formation. One or more, typically discrete, flow control devices are placed in the wellbore within each production zone to control the flow of fluids from the formation into the wellbore. These flow control devices and production zones may be active or passive and are generally fluidly isolated or separated from each other by packers. Fluid from each production zone entering the wellbore typically travels along an annular area between a production tubular that runs to the surface and either a casing or the open hole formation and is then drawn into the production tubular through the flow control device. The fluid from a reservoir within a formation ("reservoir fluid") often includes solid particles, generally referred to as the "sand", which are more prevalent in unconsolidated formations. In such formations, flow control devices generally include a sand screen system that inhibits flow of the solids above a certain size into the production tubular.

It is often desirable also to have a substantially even flow of the formation fluid along a production zone or among production zones within a wellbore. In either case, uneven fluid flow may result in undesirable conditions such as invasion of a gas cone or water cone. Water or gas flow into the wellbore in even a single production zone along the wellbore can significantly reduce the amount and quality of the production of oil along the entire wellbore. Flow control devices may be actively-controlled flow control valves, such as sliding sleeves, which are operated from the surface or through autonomous active control. Other flow control devices may be passive inflow control devices designed to preferentially permit production or flow of a desired fluid into the wellbore, while inhibiting the flow of water and/or gas or other undesired fluids from the production zones. Sand screens utilized in production zones typically lack a perforated base pipe and require the formation fluid to pass through the screen filtration layers before such fluid can travel along the annular pathway along approximately the entire length of the production zone before it enters the production tubular at a discrete location.

The present disclosure addresses to the deployment and use of ICD's and other well tools.

SUMMARY OF THE DISCLOSURE

In aspects, the present disclosure provides an apparatus for controlling a flow of a fluid between a wellbore tubular and a wellbore annulus. The apparatus may include an inflow control device having an opening in fluid communication with a bore of the wellbore tubular, a first particulate control device forming a first fluid stream conveyed to the inflow control device; and at least one degradable flow blocker blocking fluid flow through the inflow control device.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION

Figure 1:
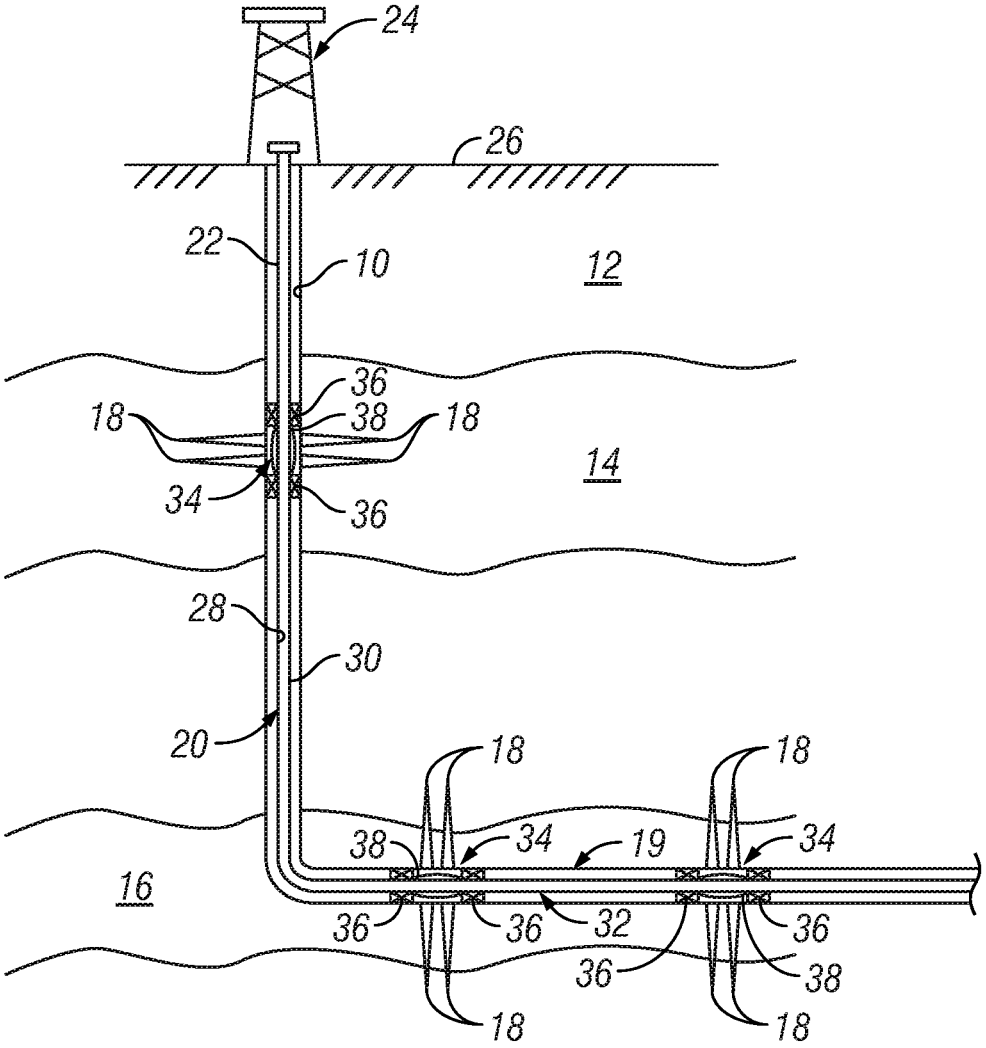
FIG. 1 is a schematic elevation view of an exemplary multi-zonal wellbore and production assembly which incorporates an inflow control system in accordance with one embodiment of the present disclosure.

The present disclosure relates to devices and methods for deploying and using well tools. In several embodiments, the devices describe herein may be used with a hydrocarbon producing well. In other embodiments, the devices and related methods may be used in geothermal applications, ground water applications, etc. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flow bore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Although only a few production nipples 34 are shown in FIG. 1, there may, in fact, be a large number of such nipples arranged in serial fashion along the horizontal portion 32.

Each production nipple 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
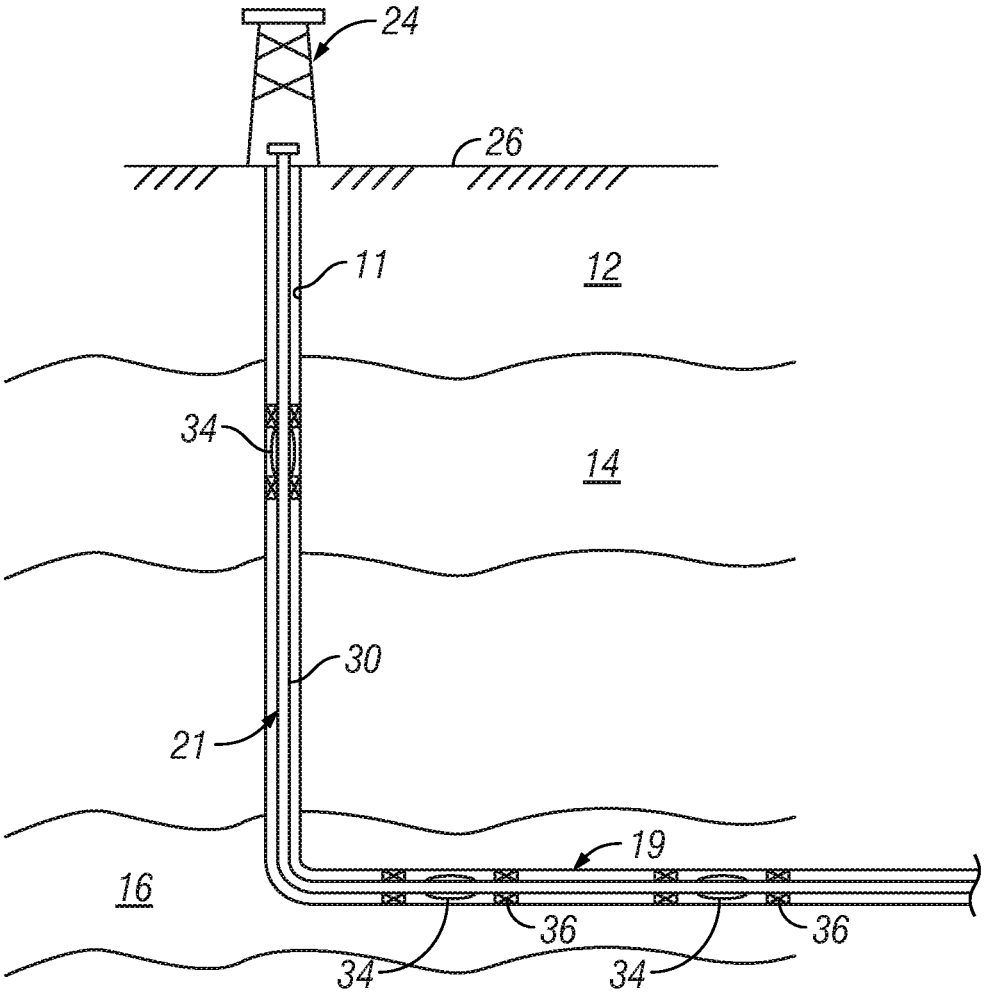
FIG. 2 is a schematic elevation view of an exemplary open hole production assembly which incorporates an inflow control system in accordance with one embodiment of the present disclosure.

FIG. 2 illustrates an exemplary open hole wellbore 11 wherein the production devices of the present disclosure may be used. Construction and operation of the open hole wellbore 11 is similar in most respects to the wellbore 10 (FIG. 1) described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and the packers 36 may be used to separate the production nipples. However, there may be some situations where the packers 36 are omitted. The nature of the production control device is such that the fluid flow is directed from the formation 16 directly to the nearest production nipple 34.

Figure 3:
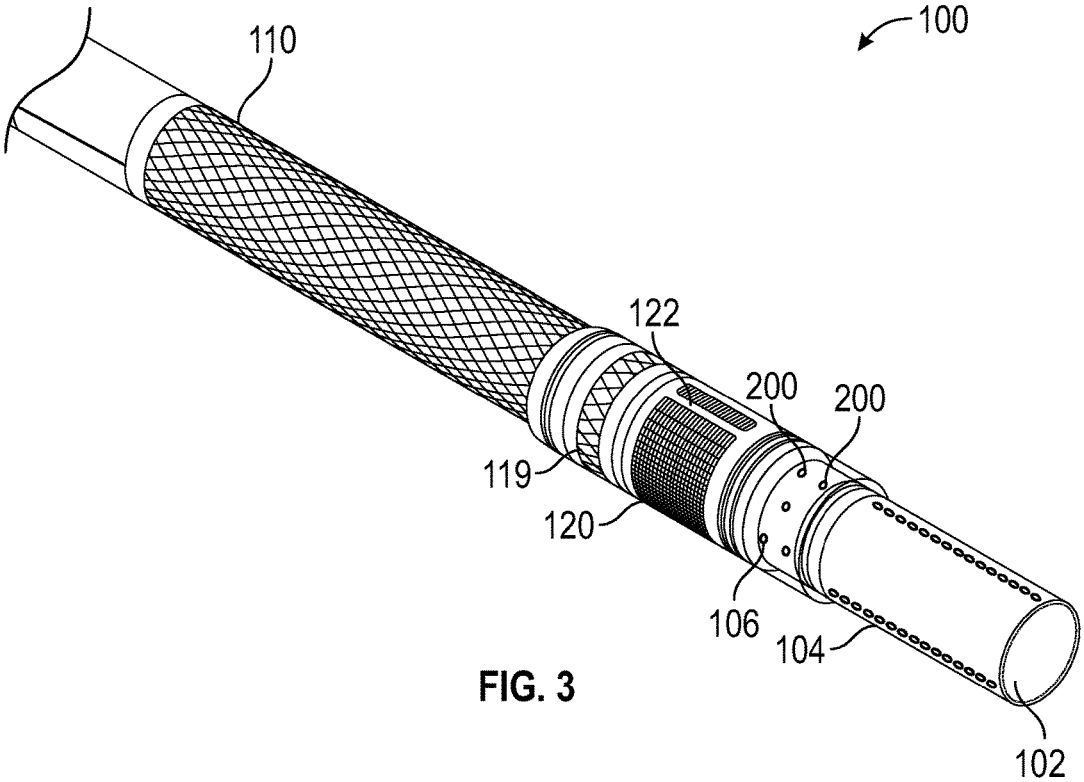
FIG. 3 is a sectional view of an exemplary production control device that includes a degradable flow blocker in accordance with one embodiment of the present disclosure.

Referring now to FIG. 3, there is shown one embodiment of a production or injection control device 100 for controlling the flow of fluids between a reservoir and a flow bore 102 of a tubular 104 along a production string (e.g., tubing string 22 of FIG. 1). The control devices 100 may be distributed along a section of a production well to provide fluid control at multiple locations. This can be useful, for example, to impose a desired drainage or production influx pattern. By appropriately configuring the production control devices 100, a well owner can increase the likelihood that an oil or gas bearing reservoir will drain efficiently. This drainage pattern may include equal drainage from all zones or individualized and different drainage rates for one or more production zones. During injection operations, wherein a fluid such as water or steam is directed into the reservoir, the devices 100 may be used to distribute the injected fluid in a desired manner. Exemplary production control devices are discussed herein below.

In one embodiment, the production control device 100 includes one or more particulate control devices 110 for reducing the amount and size of particulates entrained in the fluids and an in-flow control device 120 that control overall drainage rate from the formation. The particulate control devices 110 can include known devices such as sand screens and associated gravel packs. In embodiments, the in-flow control device 120 utilizes flow channels, orifices, and/or other geometries that control in-flow rate and/or the type of fluids entering the flow bore 102 of a tubular 104 via one or more flow bore openings 106. The in-flow control device 120 may also include other components such as a flow diffuser 119.

The in-flow control device 120 may have flow passages 122 that may include channels, orifices bores, annular spaces and/or hybrid geometry, that are constructed to generate a predetermined pressure differential across the in-flow device 120. By hybrid, it is meant that a give flow passage may incorporate two or more different geometries (e.g., shape, dimensions, etc.). By predetermined, it is meant that the passage generates a pressure drop greater than the pressure drop that would naturally occur with fluid flowing directly across the in-flow control device 120. Additionally, by predetermined it is meant that the pressure drop has been determined by first estimating a pressure parameter relating to a formation fluid or other subsurface fluid. The flow passage 120 is configured to convey fluid between the particulate control devices 110 and the flow bore 102. It should be understood that the flow passage 122 may utilize helical channels, radial channels, chambers, orifices, circular channels, etc.

In one non-limiting embodiment, one or more degradable flow blockers 200 may be used to temporarily seal each of the flow bore openings 106. The flow blocker 200 may be formed of one or more materials that disintegrate in response to an applied stimulus or encountered environmental condition. Exemplary types of disintegration include, but are not limited to, oxidizing, dissolving, melting, fracturing, and other such mechanisms that cause a structure to lose integrity and fail or collapse. Before disintegrating, the flow blocker 200 forms a fluid tight seal between the flow passage 122 and the flow bore 102. In embodiments, the flow blocker 200 has sufficient structural integrity to maintain the seal for pressure differentials exceeding 10,000 PSI. In one non-limiting embodiment, the flow blocker 200 may formed as a threaded plug that threads into flow bore openings 106, which have complementary threads.

The flow blocker 200 maintains the seal until one or more predetermined conditions occur after the in-flow control device 120 is positioned in the wellbore. Generally speaking, the predetermined condition is associated or based on an environmental input such as thermal energy (i.e., ambient temperature) or physical contact with naturally occurring substance, such as water or brine. The predetermined condition may also be associated or based on a substance pumped via the flow bore 102 from the surface (e.g., an acid, a fracturing fluid, stimulation fluid, water, etc.). Still other conditions may be associated or based on naturally occurring or human-made electromagnetic energy, acoustical energy, etc. The material making up the flow blocker 200 reacts to the applied condition(s) by disintegrating.

In one mode of use, the flow blockers 200 are positioned in the flow bore openings 106 at the surface and before the inflow control device 120 is conveyed into wellbore 10. Thus, the internals of the in-flow control device 120 is protected from inflowing fluid from the flow bore 102. The flow path 122 is usually open to the wellbore annulus, which will allow some wellbore fluid to reside in the flow path 122 as the in-flow control device 120 is conveyed along the wellbore 10. However, the flow blockers 200 prevent fluid from the exterior of the in-flow control device 200 from continuously flowing through the flow path 122.

After the in-flow control device 120 is positioned at a desired location in the wellbore 10, the flow blockers 200 are subjected to one or more of the predetermined condition. For instance, the predetermined condition may be contact with a naturally occurring brine from an formation. As used herein, "naturally occurring" means that the substance was not introduced into the environment by human activity. The brine seeps into the flow path 122 and interact with the material making up the flow blockers 200. This interaction causes the flow blockers 200 to degrade and lose structural integrity. Eventually, the flow blockers 200 disintegrate to the point where a pressure differential cannot be maintained. At that time, the flow bore openings 106 open and the remnants of the flow blockers 200 become entrained in the produced brine and flushed from the in-flow control device 120.

In another scenario, the predetermined condition may be a predicted ambient temperature (e.g., 200 degrees F.) at a target depth. The heat degrades the material(s) forming the flow blockers 200, which then leads to a loss of structural integrity. The loss of structural integrity causes the flow blocker 200 to disintegrate and allow flow.

In still another scenario, the predetermined condition may be contact with a substance pumped from the surface. The substance may be seawater or an engineered substance such as an acid. This substance flows to the flow blockers 200 via the flow bore 102. Upon contact, the substance interacts with the material(s) forming the flow blockers 200, which then leads to a loss of structural integrity. The loss of structural integrity causes the flow blocker 200 to disintegrate and allow flow.

Figure 4:
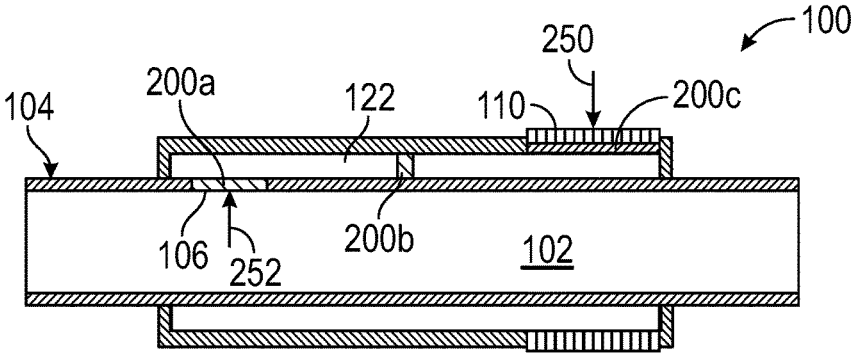
FIG. 4 illustrates another exemplary production control device that includes a degradable flow blocker in accordance with one embodiment of the present disclosure.

Referring now to FIG. 4, there is shown generically illustrated a production or injection control device 100 for controlling the flow of fluids between a reservoir and a flow bore 102 of a tubular 104 along a production string (e.g., tubing string 22 of FIG. 1). Arrow 250 shows the direction of flow of fluids from the reservoir during production. Arrow 252 shows the direction of the flow of fluids during injection operations. The device 100 includes one or more particulate control devices 110 and a flow passage 122 that may utilize flow channels, orifices, and/or other geometries that control in-flow or out-flow rate and/or the type of fluids entering the flow bore 102 of a tubular 104 via one or more flow bore openings 106.

FIG. 4 illustrates that one or more flow blockers 200 may be positioned at any number of locations associated with the device 100. Merely by way of illustration, a flow blocker 200*a* is shown blocking flow at the inlets(s) 106, a flow blocker 200*b* is shown positioned along the flow passage 122, and a flow blocker 200*c* is shown blocking flow across the particulate control device 110. The flow blocker 200*c* may be positioned at the interior, the exterior, within the particulate control device 110. A flow blocker 200 may be positioned at any one or a plurality of these locations.

It should be appreciated that the flow blocker 200 may configured to withstand the pressure differentials encountered while a pressure in the flow bore 102 is increased during conventional well completion activities. For example, relatively high pressures may be encountered while setting packers, actuating sliding sleeves, testing completion string integrity, etc. The flow blockers 200 protect the internals of in-flow control devices 120 from fluid flow during these pressure-up situations, which then allows personnel to pump through to the bottom of the completion string.

The flow blocker 200 may be formed as a plug, a sleeve, a rib, or any other structure that is configured to withstand an applied pressure differential until the predetermined condition occurs.

Any degradable material may be used to form the flow blocker 200. As used herein, the term "degradable" refers to a loss of structural integrity within days, hours, or even minutes of exposure to a predetermined condition. In variants, the flow blocker 200 loses the ability to support a loading or performing its intended function within six hours of exposure, within twelve hours of exposure, within twenty-four hours of expose, within seventy two hours of exposure, within seven days of exposure, or within fourteen days of expose. In embodiments, the flow blocker 200 may before formed of one or more lightweight, high-strength metallic materials. These lightweight, high-strength and selectably and controllably degradable materials may include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed as dispersed particles within a cellular nanomatrix formed from the various nanoscale metallic coating layers of metallic coating materials, and are particularly useful in wellbore applications. The core material of the dispersed particles also includes a plurality of distributed carbon nanoparticles. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact.

The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below. The distributed carbon nanoparticles provide further strengthening of the core material of the dispersed particles, thereby providing enhanced strengthening of the powder compact as compared, for example, to powder compacts having dispersed particles that do not include them. Also, the density of certain distributed carbon nanoparticles may be lower than the dispersed metal particle core materials, thereby enabling powder compact materials with a lower density, as compared, for example, to powder compacts having dispersed particle cores that do not include them. Thus, the use of distributed carbon nanoparticles in nanomatrix metal composite compacts may provide materials having even higher strength to weight ratios than nanomatrix metal compacts that do not include the distributed carbon nanoparticles. Such materials are disclosed in US20120103135, U.S. application Ser. No. 12/913,321, filed on May 3, 2012, the contents of which are incorporated by reference for all purposes. One non-limiting and commercially available material that is suitable is IN-TALLIC.

As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below. Such materials are disclosed in US20110136707, U.S. Ser. No. 12/633,678, filed on Dec. 8, 2009, the contents of which are incorporated by reference for all purposes.

The flow blockers 200 may also be formed of degradable material such as biopolymers such as PLA resin, zein, or poly-3-hydroxybutyrate. These materials may be formulated to rapidly degrade when exposed to temperatures found in a wellbore environment.

Figure 5:
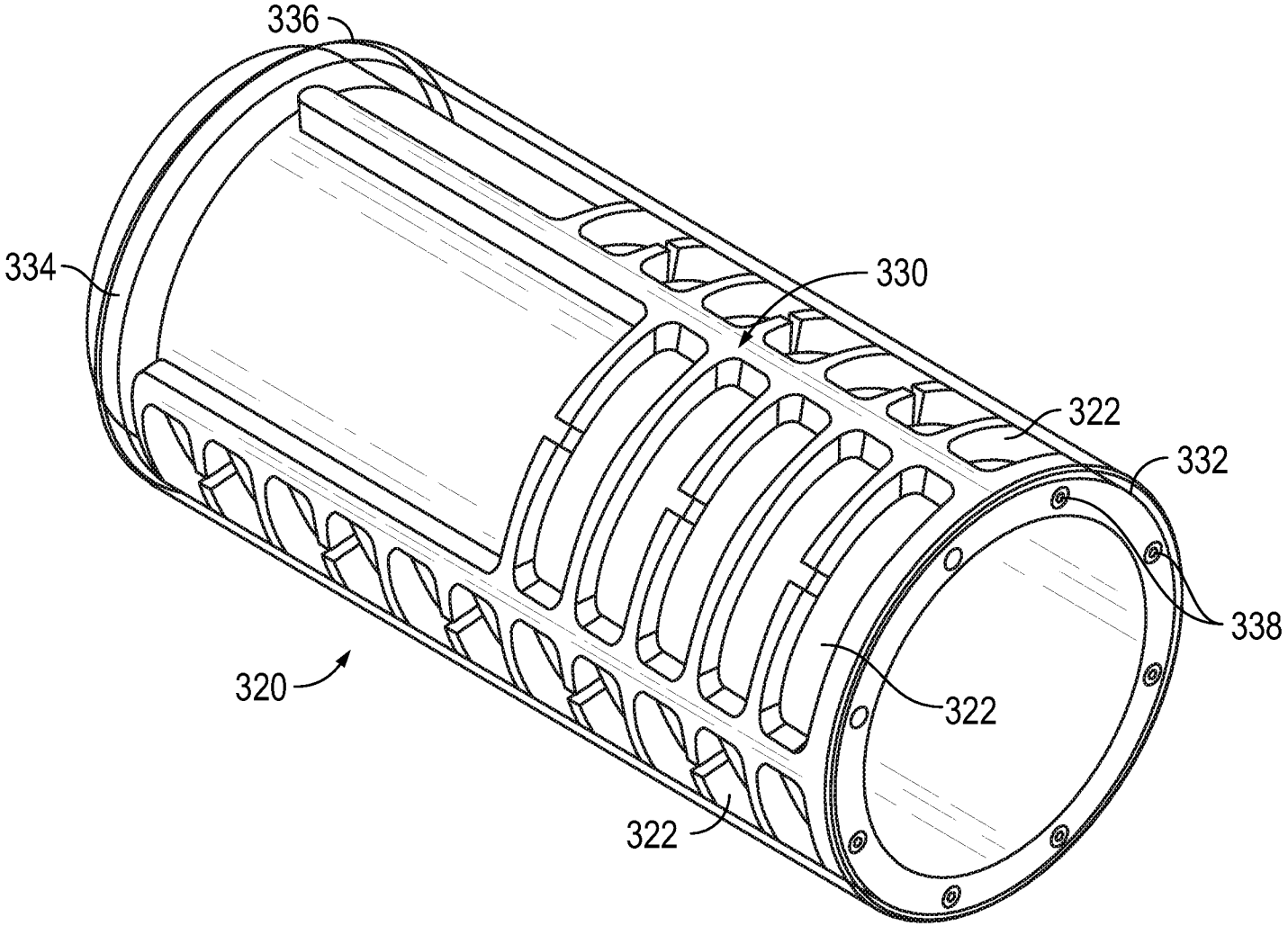
FIG. 5 illustrates yet another exemplary production control device that includes a degradable flow blocker in accordance with one embodiment of the present disclosure.

Referring now to FIG. 5, there are shown details of one non-limiting embodiment of a flow control device 320 that includes one or more degradable flow blocker according to the present disclosure. While not required, the conduits 322 may be aligned in a parallel fashion and longitudinally along the long axis of the flow control device mandrel 330. Each conduit 322 may have one end 332 in fluid communication with the wellbore tubular flow bore 102 (FIG. 3) and a second end 334 that is in fluid communication with the annular space or annulus (not shown) separating the flow control device 320 and the formation. Generally, each conduit 322 is hydraulically separated from one another, at least in the region between their respective ends 332, 334, i.e., the conduits 322 are hydraulically parallel. An outer housing 336, shown in hidden lines, encloses the mandrel 330 such that the conduits 322 are the only paths for fluid flow across the mandrel 330. In embodiments, along the mandrel 330, at least two of the conduits 322 provide independent flow paths between the annulus and the tubular flow bore 102 (FIG. 3). One or more of the conduits 322 may be configured to receive a degradable flow blocker as described above that either partially or completely restricts flow across that conduit 322. In one arrangement, the degradable flow blocker may be a plug 338 that is received at the second end 334. For instance, the plug 338 may be threaded or chemically affixed to the first end 332 (or inlet). In other embodiments, the closure element may be affixed to the second end 334. In still other embodiments, the closure element may be positioned anywhere along the length of a conduit 322.

It should be understood that the above described embodiments are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure. For example, though the embodiments herein disclose details in a production environment, it is known in the art and should be understood that the various embodiments are also contemplated to be used in an injection environment including CSS, steam assisted gravity drainage ("SAGD") and other conventional wellbore fluid flow solutions known in the art where inflow control and sand control may be desired. Still further, though the embodiments contemplate inflow control integrated within a sand screen system, it is also contemplated that where sand control is not desired, an embodiment of the invention may provide preferential discrete distributed inflow control in a robust system even where gauge spacing and the like fail to provide adequate sand control.

What is claimed is:

1. An apparatus for controlling a flow of a fluid between a wellbore tubular and a wellbore annulus, comprising:

an inflow control device configured to generate a predetermined pressure drop in the flowing fluid, the inflow control device having a first opening in fluid communication with a bore of the wellbore tubular and a second opening;

a particulate control device in fluid communication with the inflow control device via the second opening and having at least one opening in fluid communication with the wellbore annulus; and at least one degradable flow blocker blocking fluid flow between the at least one opening of the particulate control device and the second opening of the inflow control device, wherein the at least one degradable flow blocker blocks all fluid flow between the at least one opening of the particulate control device and the second opening of the inflow control device.

2. The apparatus of claim 1, wherein the inflow control device includes at least one passage communicating all fluid flow between the particulate control device and the first opening of the inflow control device, and wherein the at least one degradable flow blocker forms a fluid seal in the at least one passage.

3. The apparatus of claim 1, wherein the at least one degradable flow blocker physically engages and seals the second opening.

4. The apparatus of claim 1, wherein the at least one degradable flow blocker is positioned inside the second opening.

5. The apparatus of claim 1, wherein the at least one degradable flow blocker is formed at least partially of a material that degrades in response to one of: (i) an applied stimulus, and (ii) an encountered environmental condition.

6. The apparatus of claim 5, wherein the degradation includes at least one of: (i) oxidizing, (ii) dissolving, (iii) melting, and (iv) fracturing.

7. The apparatus of claim 3, wherein the disintegration is in response to: (i) applied thermal energy, (ii) contact with a naturally occurring substance, and (iii) a substance introduced from a surface location.

8. The apparatus of claim 1, wherein the at least one degradable flow blocker includes a plurality of degradable flow blockers, wherein the inflow control device includes a plurality of openings in fluid communication with the particular control device, the second opening being one of the plurality of openings, and wherein a flow blocker of the plurality of degradable flow blockers is affixed inside each of the plurality of openings.

9. A method for controlling a flow of a fluid between a wellbore tubular and a wellbore annulus, comprising:

configuring an inflow control device to generate a predetermined pressure drop the fluid flowing through the inflow control device, the inflow control device having a first opening in fluid communication with a bore of the wellbore tubular and a second opening;

enabling fluid communication between the inflow control device and a particulate control device having at least one opening in fluid communication with the wellbore annulus; and temporarily blocking fluid flow between the at least one opening of the particulate control device and the second opening of the inflow control device using at least one degradable flow blocker.

10. The method of claim 9, wherein the at least one degradable flow blocker blocks all fluid flow between the at least one opening of the particulate control device and the inflow control device.

11. The method of claim 9, further comprising installing the at least one degradable flow blocker in inflow control device, wherein the installation is done before the inflow device and the particulate control device are positioned in a wellbore.

12. The method of claim 9, wherein the at least one degradable flow blocker is formed at least partially of a material that disintegrates in response to one of: (i) an applied stimulus, and (ii) an encountered environmental condition.

13. The method of claim 12, further comprising introduce a substance from a surface location to disintegrate the at least one degradable flow blocker.

* * * * *